US005299707A

United States Patent [19]

Stolzman

[11] Patent Number: 5,299,707

[45] Date of Patent: Apr. 5, 1994

[54] WELDED COVER LOCK

[76] Inventor: Michael D. Stolzman, 1188 Old Colony Rd., Lake Forest, Ill. 60045

[21] Appl. No.: 953,648

[22] Filed: Sep. 29, 1992

[51] Int. Cl.[5] ..... B65D 45/34

[52] U.S. Cl. ..... 220/321; 220/315; 220/319; 24/16 PB

[58] Field of Search ..... 220/315, 319, 320, 321; 24/16 PB, 17 AP, 273

[56] References Cited

U.S. PATENT DOCUMENTS

| | | | |
|---|---|---|---|
| 2,289,422 | 7/1942 | Grotnes | 24/273 |
| 2,864,638 | 12/1958 | Nelson et al. | 24/273 X |
| 3,103,293 | 9/1963 | Beutler | 220/321 |
| 3,561,637 | 2/1971 | McConnell | 220/320 |
| 3,637,257 | 1/1972 | Uncapher | 220/321 X |
| 3,897,884 | 8/1975 | Lankenau | 220/320 |
| 4,135,657 | 1/1979 | Benson et al. | 220/321 X |
| 4,164,804 | 8/1979 | Fletcher | 24/273 |
| 4,267,940 | 5/1981 | Wade | 220/321 |
| 4,955,504 | 9/1990 | Lesscher | 220/352 |
| 5,129,537 | 7/1992 | Bordner et al. | 220/321 |

*Primary Examiner*—Allan N. Shoop
*Assistant Examiner*—Vanessa Caretto
*Attorney, Agent, or Firm*—Woods, Phillips, Van Santen, Hoffman & Ertel

[57] ABSTRACT

A lock is provided for use with a container having an annular end portion defining a top opening and a radially outwardly opening annular recess. A top wall defines a removable cover overlying the opening. The lock includes an elongate band of synthetic resin operatively associated with and circumferentially surrounding the top wall with opposite ends spaced apart and having radially inwardly projecting securing structure receivable in the recess for securing the top wall to the container. A locking structure is provided for constricting the spaced ends of the band to urge the securing structure radially inwardly comprising a pair of radially out-turned tabs of a high-strength synthetic resin secured to opposite end portions of the band as by vibration welding. A locking lever is movable to an over center position for adjustably drawing the tabs toward each other and releasably locking the securing structure in the annular recess in the over center position.

16 Claims, 2 Drawing Sheets

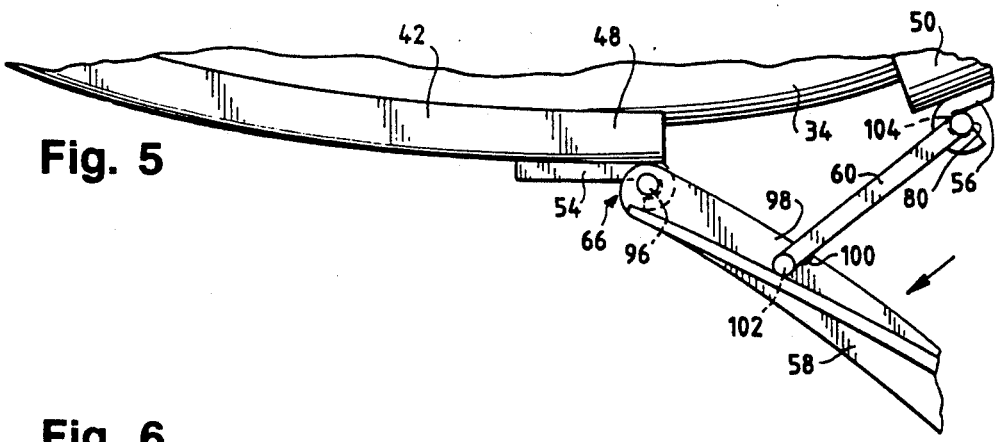
Fig. 5
Fig. 6
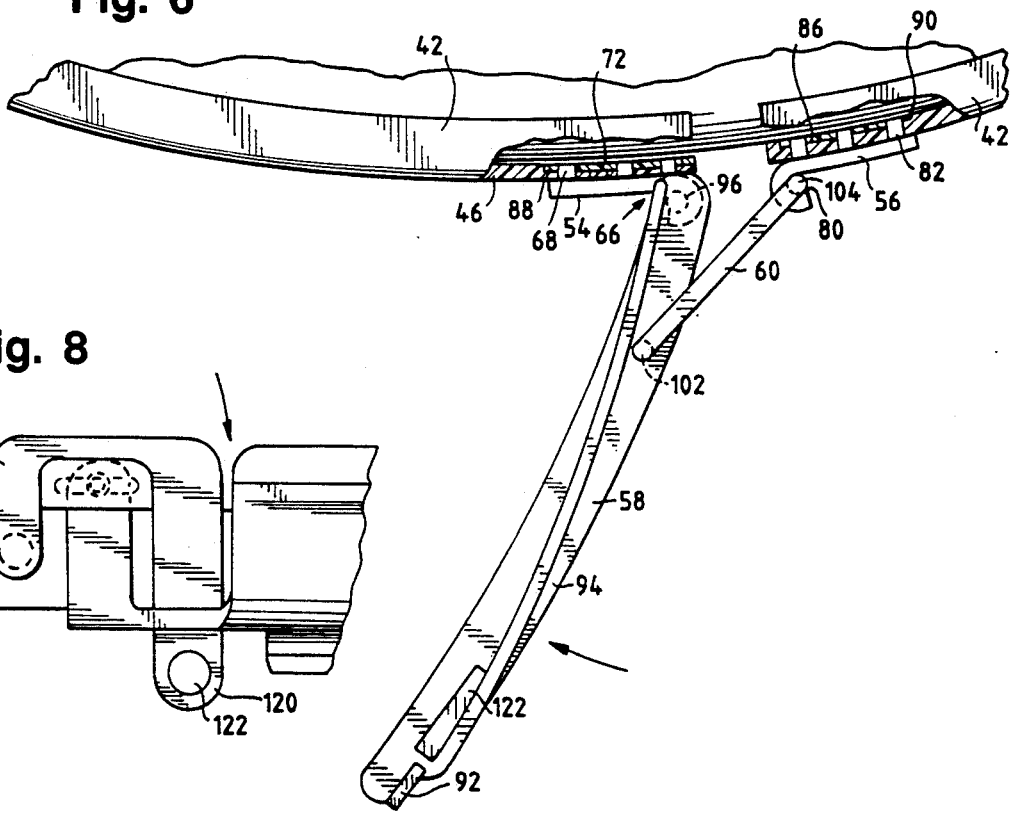
Fig. 8
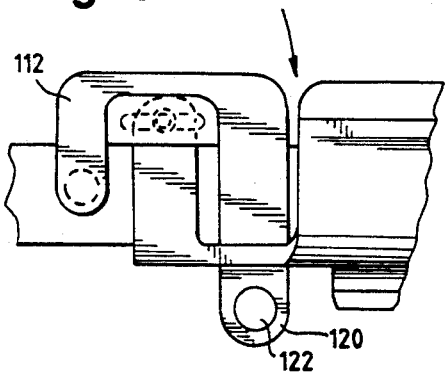
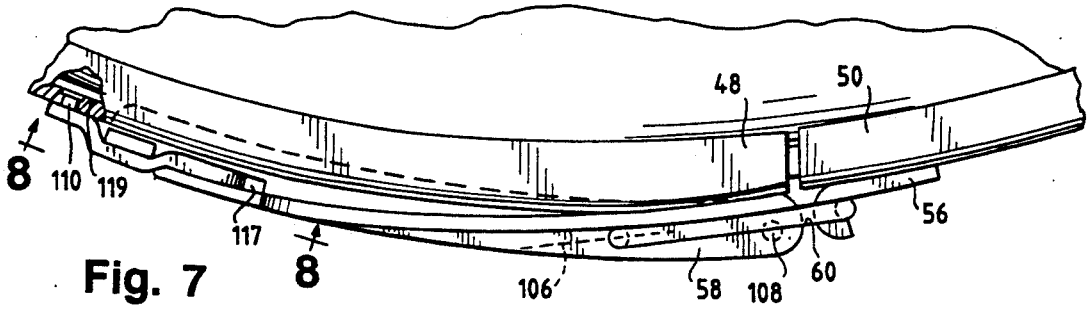
Fig. 7

WELDED COVER LOCK

FIELD OF THE INVENTION

This invention relates to containers and, more particularly, to a welded cover lock for securing the cover to the container.

BACKGROUND OF THE INVENTION

In one form of conventional shipping and storage container, a tubular sidewall is formed of fibrous material or other material. It is conventional to provide metal retaining rings at opposite ends of the sidewall for securing closure walls thereacross. Such metal retaining rings are relatively costly and heavy and are not fully satisfactory in the formation of a low cost shipping and storage container.

The container closure may be provided with locking structure secured thereto for retaining the closure on the container. An example of such a closure is disclosed in my U.S. Pat. No. 4,805,798. With such a container, the closure includes tabs integrally molded therewith which are drawn together to constrict a sidewall of the closure for retaining it to the container. The closure is molded of synthetic resin. While such a closure is generally satisfactory, the conventional synthetic resin may not be strong enough to survive continued locking and unlocking of the locking structure. While the cover could be molded of a high-strength engineering resin, doing so would significantly increase costs of the closure. In marketing of such a closure, a customer must then balance the advantages of the increased strength capabilities with the significantly higher costs required.

In another form of closure, a removable cover is configured to rest on an annular connecting ring at the top of the container and a locking belt is used to secure the cover to the connecting ring. The locking belt most commonly has been formed of metal and including metal locking structure riveted thereto. Such a metal locking belt can be expensive and produces problems of its own if the container is ultimately incinerated, as it is necessary to remove the metal from the incinerator.

Known locking belts have also been formed of synthetic resin and provided with locking structures similar to that described above. Such locking belts suffer the same problems. Particularly, either the locking belt is molded of synthetic resin, resulting in a lack of strength, or it can be formed of a high strength resin, increasing the cost.

The present invention is directed to solving one or more of the problems discussed above in a novel and simple manner.

SUMMARY OF THE INVENTION

In accordance with the invention, there is disclosed a locking structure of two different types of resin.

Broadly, there is disclosed herein a cover lock for use with a container having an annular end portion defining a top opening and a radially outwardly opening annular recess, and a top wall defining a removable cover overlying the opening. The cover lock comprises an elongate band of synthetic resin operatively associated with and circumferentially surrounding the top wall with opposite ends spaced apart and having radially inwardly projecting securing structure receivable in the recess for securing the top wall to the container. Means are provided for constricting the spaced ends of the band to urge the securing structure radially inwardly comprising a pair of radially outturned tabs of a high strength synthetic resin, means for securing the tabs to the opposite end portions of the band, and retaining means movable to an over center position for adjustably drawing the tabs toward each other and releasably locking the securing structure in the annular recess when the retaining means is in the over center position.

It is a feature of the invention that the band further comprises a second radially inwardly projecting securing structure overlapping an outer circumferential edge of the top wall for sandwiching the top wall between the annular end portion and the second securing structure.

It is a feature of the invention that the tabs are of nylon.

It is another feature of the invention that the tabs are of glass-filled nylon.

It is an additional feature of the invention that the securing means comprises means for welding the tabs to opposite end portions of the band.

It is an additional feature of the invention that the tabs include a plurality of posts receivable in openings in the band and the securing means comprises means for welding the posts to backing plates, the backing plates and tabs sandwiching the band.

In accordance with another aspect of the invention, the retaining means comprises a loop element having a first portion embracing one of the tabs, and an opposite second portion, and a lever having a first portion partially engaged in the other of the tabs, and a second portion embracing the second portion of the loop element being disposed in the over center position relative to a line through the first portion of the loop element and the first portion of the lever in the over center position of the retaining means.

It is a feature of the invention that the lever is of nylon.

It is a further feature of the invention that the lever is of glass-filled nylon.

There is disclosed in accordance with a further aspect of the invention a locking belt for use with a container having an annular end portion defining a top opening and a top wall defining a removable cover overlying the opening. The locking belt comprises an elongate band of synthetic resin for surrounding the annular end portion of the container including means for retaining the cover on the annular end portion with opposite ends of the band spaced apart. A locking structure of high strength synthetic resin is provided. Means are also provided for securing the locking structure to the end portion of the bands, so that the locking structure constricts the spaced ends of the band to secure the cover to the container.

It is a feature of the invention that the band comprises a C-shaped band in cross-section having parallel upper and lower wall portions connected by a sidewall portion, the sidewall portion extending around the container annular end portion with the lower wall portion extending into an annular recess in the annular end portion and the upper wall portion extending above an outer peripheral portion of the top wall.

Further features and advantages of the invention will readily be apparent from the specification and from the drawing.

BRIEF DESCRIPTION OF THE DRAWING

FIG. 5 is a partial plan view illustrating the locking band of FIG. 1 in an unlocked position;

FIG. 6 is a view similar to that of FIG. 5 showing further details of the securing of the locking structure to a locking band with the locking belt in an intermediate position;

FIG. 7 is a view similar to that of FIG. 6 showing further details of a latch structure with the locking structure in the locked position; and FIG. 8 is a detailed view taken along the line 8—8 of FIG. 7.

DETAILED DESCRIPTION OF THE INVENTION

Figure 1:
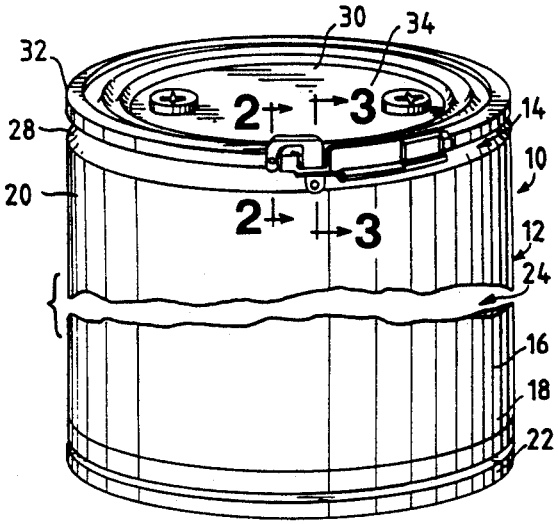
FIG. 1 is a partial, perspective view of a container including a cover lock according to the invention.
Figure 2:
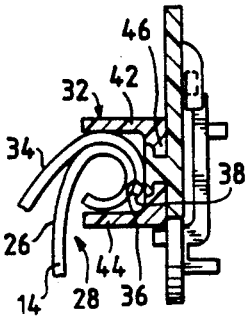
FIG. 2 is a sectional view taken along the line 2—2 of FIG. 1.
Figure 3:
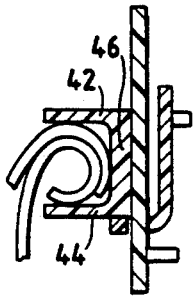
FIG. 3 is a sectional view taken along the line 3—3 of FIG. 1.

In the illustrated embodiment of the invention, as disclosed in FIGS. 1-3, a container 10 includes a drum 12 having a connecting ring in the form of a chime 14 adhered thereto. The drum 12 includes a fibrous, tubular sidewall 16. The sidewall 16 defines a right cylinder, it being understood that the sidewall may define other configurations, such as square, oval, et cetera.

The sidewall 16 has a lower end portion 18 and an upper end portion 20. The lower end portion 18 is closed by a bottom wall (not shown) secured by a connecting ring 22. The drum 12 defines an internal storage space 24 for holding materials. The top portion 20 is generally open and includes the chime 14 defining an annular end portion having a top opening 26 and a radially outwardly opening annular recess 28. The top opening 26 is selectively closed by a closure 30 securable to the chime 14 using a locking belt 32.

As illustrated in the drawing, the chime 14 may comprise a metal connecting ring rolled to the top of the sidewall 16 or may comprise a plastic chime secured to the top of the sidewall 16 such as described in my U.S. Pat. No. 4,805,798, the specification of which is hereby incorporated by reference herein.

The closure 30 is of unitary construction and in the illustrated embodiment is injection molded of suitable synthetic resin. The closure 30 includes a generally circular top wall 34 and a generally cylindrical, continuous downwardly turned sidewall 36. When the closure 30 is seated on the chime 14, the sidewall 36 is seated radially outwardly of the chime 14 with a continuous annular lower edge 38 positioned above the annular recess 28.

Figure 4:
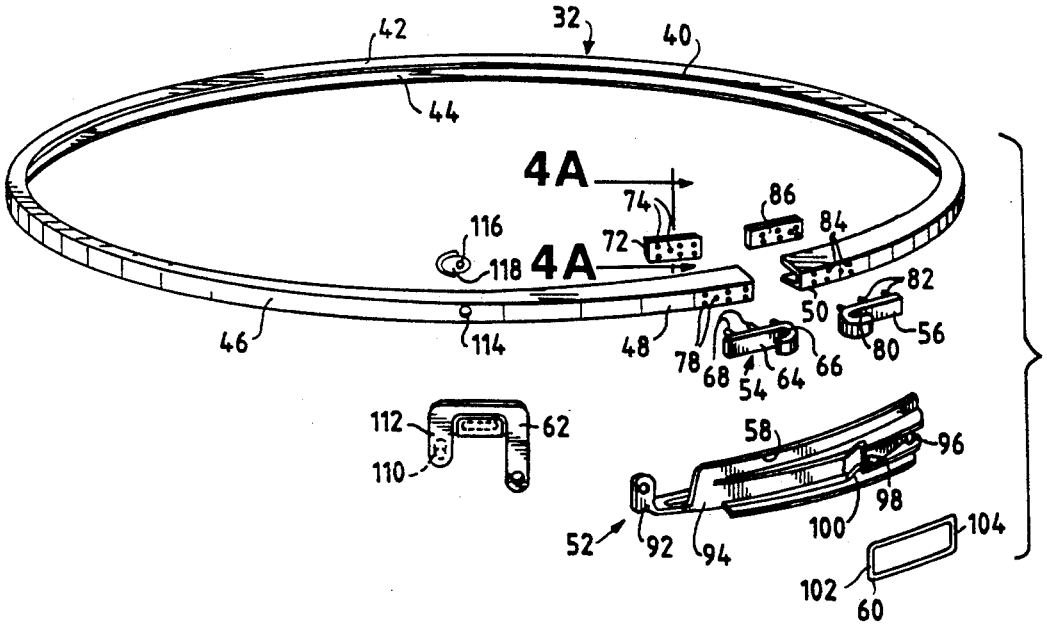
FIG. 4 is an exploded view illustrating the locking belt of FIG. 1.

The locking belt 32, see also FIG. 4, includes a substantially C-shaped band 40 in cross-section having parallel upper wall portion 42 and lower wall portion 44 connected by a sidewall portion 46. The sidewall portion 46 extends around the closure sidewall 36 with the lower wall portion 44 extending into the chime recess 28 and the upper wall portion 42 extending above an outer peripheral portion of the closure circular wall 34. Particularly, the upper wall portion 42 and the chime 14 sandwich the outer peripheral edge of the top wall 34.

The band 40 is injection molded of synthetic resin such as high load melt index resin. It is molded in a generally circular configuration, as shown in FIG. 4, with spaced ends 48 and 50. To secure the closure 30 to the drum 12, it is necessary to constrict the spaced ends 48 and 50 to urge the lower wall portion 44 radially inwardly. To do so, a locking structure 52 is provided. The locking structure 52 comprises a first tab 54, a second tab 56, a lever 58, a loop 60 and a latch 62. The locking structure 52 is operable to constrict the spaced ends 48 and 50.

Although not specifically shown herein, the locking structure 52 could be used to constrict opposite portions of a split annular flange on a removable closure member, such as disclosed in my U.S. Pat. No. 4,805,798, which has been previously incorporated by reference herein. The difference between the locking structure 52 and that disclosed in my '798 patent is the feature of the tabs 54 and 56 being separately formed and subsequently secured as by vibration welding, as discussed below.

Thus, the locking structure in accordance with the invention can be used in connection with a locking belt for locking a cover to a drum or in connection with a cover including a sidewall having a split annular flange.

Figure 4A:
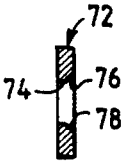
FIG. 4A is a sectional view taken along the line 4A—4A of FIG. 4.

The tab 54 comprises a plate 64 turned at one end to define a recess 66. A plurality of posts 68 extend rearwardly from the plate 64. To secure the first tab 54 to the band first end 48, the posts 68 are inserted through a plurality of corresponding openings 70 in the first end 48. Positioned radially inwardly in the band first end 48 is a backing plate 72. With reference also to FIG. 4A, the backing plate 72 includes a plurality of through openings 74 corresponding to the configuration of the posts 68 and the belt openings 70. Each of the band openings 70 is of a diameter slightly larger than the diameter of the posts 68. The plate through openings 74 are of a diameter smaller than the diameter of the posts 68. At each plate opening 74 is a counterbore 76 of a diameter approximately equal to the diameter of the posts 68 to define a shoulder 78 therebetween. After the posts 68 are inserted through the band openings 70, they extend into the backing plate openings 74 and rest on the shoulder 78. The posts 68 are then secured to the backing plate 72 as by vibration welding the components together. Particularly, the backing plate 74 and tab 54 are molded of a high strength engineering resin, such as glass-filled nylon. The parts are then vibrated relative to one another using conventional welding apparatus (not shown) at ultrasonic frequencies so that the resin in the areas where they abut one another generate a frictional heat buildup so that the posts 68 are effectively welded to the backing plate 72. As a result, the tab plate 64 and backing plate 72 sandwich the band first end 48 to secure it thereto.

The second tab 56 is generally similar to the first tab 64, albeit a mirror image and includes a recess 80 and a plurality of posts 82. The second tab 56 is secured to the band second end 50 as by inserting the posts 82 through band openings 84 and welding the posts 82 to a second backing plate 86, similar to the backing plate 72. The second tab 56 and second backing plate 86 are also formed of a high strength engineering resin, such as glass-filled nylon.

With the tabs 54 and 56 secured to the belt 32, the recesses 66 and 80 open opposite to one another. As shown, the wall of the respective tabs 54 and 56 extend more than 180 about the respective recesses 66 and 80 to define an undercut configuration.

To provide a smooth inner surface on the inner side of the band sidewall portion 46, a pair of notches 88 and 90 are provided of a size and shape for receiving the respective backer plates 72 and 86, see FIG. 6. Thus, the plates 72 and 86 are flush mounted so that they do not interfere with operation of the belt 32.

The lever 58 includes a latching portion 92 at one end connected to a handle portion 94 and a pivot post 96 at an opposite end. A hook portion 98 is provided between the handle portion 94 and pivot post 96 and defines an outwardly opening recess 100, which is similar to the recesses 66 and 80 in having a circular cross-section extending slightly more than 180°.

The loop element 60 defines opposite rectilinearly extending ends 102 and 104.

The lever 58, loop element 60 and latch 62 are also molded of a high strength engineering resin, such as glass-filled nylon.

The locking structure 52 is used to draw the tabs 54 and 56 together using the lever 58 and loop element 60. This is accomplished by firstly positioning the loop element end 104 in the recess 80 of the second tab 56 with the pivot post 96 of the lever 58 received in the recess 66 of the first tab 54 and the first end 102 of the loop elements 60 received in the recess 100 of the lever hook portion 98, as illustrated in FIGS. 5 and 6. The lever handle portion 94 is then pivoted in a clockwise direction, as shown comparing FIGS. 5 and 6, with the pivot 96 rotating in the recess 66 to an over center position wherein a line 106 drawn through the center of the loop element ends 102 and 104 lies inwardly of an axis of the pivot post, represented by a point 108, see FIG. 7. The spacing of the recess 100 from the axis of the pivot post 96 is correlated with the length of the loop element 60 between the ends 102 and 104 so that the spaced ends 48 and 50 are constricted to a substantially closed disposition, as seen in FIG. 7, with the handle in the over center locking position.

In order to lock the lever 58 in the locked position, the latch 62 is used. The latch 62 is generally J-shaped and includes a rearwardly extending post 110 extending from a shorter leg 112. The post 110 extends through an opening 114 in the belt 32 and is received in an opening 116 of a backing plate 118. The backing plate 118 is flush mounted in the band sidewall 46 as by being positioned in a corresponding recess 119, see FIG. 7. The configuration of the post 110 and backing plate opening 116 are similar to that discussed above relative to the first tab 54 and first backing plate 72. The post 110 is ultrasonically welded to the backing plate 118, as discussed above. Because of the different engineering resins used, the nylon does not adhere to the resin of the belt 42, so that the latch 62 can pivot about the post 110. As a consequence of this pivoting, the latch 62 can be pivoted in a counterclockwise direction, as shown in FIG. 8, so that the longer leg portion 120 extends downward through a slot 122 at the handle latch end 92, see also FIGS. 6 and 7, for preventing pivotal movement of the lever 58. The latch longer leg portion 120 includes an aperture 122 through which a lock, such as a padlock, can be used to prevent withdrawal of the latch leg 120 from the lever slot 122, as is well known.

In accordance with the invention, the tabs 54 and 56, lever 58, loop element 60 and latch 62 are all formed of a high strength engineering resin, such as glass-filled nylon. Resultantly, all components of the locking structure are made of a high strength nylon to permit repeated locking and unlocking of the belt 32 with minimal wear and tear on the locking structure 52. This is done in conjunction with providing a band 40 of a conventional synthetic resin at a significantly lower cost. Thus, the dual advantages of a belt having a high strength locking structure at a moderate cost results.

As discussed above, the locking structure 52 could also be used in connection with a self-locking structure having a split annular flange, such as shown in my U.S. Pat. No. 4,805,798, which was previously incorporated by reference herein.

I claim:

1. For use with a container having an annular end portion defining a top opening and a radially outwardly opening annular recess, and a top wall defining a removable cover overlying said opening, a lock comprising:

an elongate band, in use, operatively associated with and circumferentially surrounding the top wall with opposite ends spaced apart and having radially inwardly projecting securing structure receivable in said recess for securing said top wall to said container, said elongate band being made of a first synthetic resin; and means for constricting the spaced ends of the band to urge the securing structure radially inwardly comprising a pair of radially out-turned tabs of a second synthetic resin of higher strength than said first synthetic resin, said tabs mounted to the opposite end portions of said band, and retaining means movable to an overcenter position for adjustably drawing said tabs toward each other and releasably locking said securing structure in said annular recess, in use, when said retaining means is in said overcenter position.

2. The lock of claim 1 wherein said band further comprises a second radially inwardly projecting securing structure, in use, overlapping an outer circumferential edge of the top wall for sandwiching the top wall between the annular end portion and the second securing structure.

3. The lock of claim 1 wherein said tabs are of nylon.

4. The lock of claim 1 wherein said tabs are of glass filed nylon.

5. The lock of claim 1 wherein said tabs are mounted to opposite end portions of the band by welding.

6. The lock of claim 1 wherein said tabs include a plurality of posts receivable in openings in said band and said posts are mounted to backing plates by welding, said backing plates and tabs sandwiching said band.

7. For use with a container having an annular end portion defining a top opening and a radially outwardly opening annular recess, and a top wall defining a removable cover overlying said opening, a lock comprising:

an elongate band of a first synthetic resin, in use, operatively associated with and circumferentially surrounding the top wall with opposite ends spaced apart and having radially inwardly projecting securing structure receivable in said recess for securing said top wall to said container; and means for constricting the spaced ends of the band to urge the securing structure radially inwardly comprising a pair of radially out-turned tabs of a second synthetic resin of higher strength than said first synthetic resin, said tabs mounted to the opposite end portions of said band, and retaining means movable to an overcenter position for adjustably drawing said tabs toward each other and, in use, releasably locking said securing structure in said annular recess when said retaining means is in said overcenter position, said retaining means comprising a loop element having a first portion embracing one of said tabs, and an opposite second portion, and a lever having a first portion partially engaging the other of said tabs, and a second portion embracing said second portion of the loop element being disposed in the overcenter disposition relative to a line through said first portion of the loop element and said first portion of the lever in said overcenter position of the retaining means.

8. The lock of claim 7 wherein said band further comprises a second radially inwardly projecting securing structure, in use, overlapping an outer circumferential edge of the top wall for sandwiching the top wall between the annular end portion and the second securing structure.

9. The lock of claim 7 wherein said tabs and lever are of nylon.

10. The lock of claim 7 wherein said tabs and lever are of glass filed nylon.

11. The lock of claim 7 wherein said tabs are mounted to opposite end portions of the band by welding.

12. The lock of claim 7 wherein said tabs include a plurality of posts receivable in openings in said band and said posts are mounted to backing plates by welding, said backing plates and tabs sandwiching said band.

13. For use with a container having an annular end portion defining a top opening and a top wall defining a removable cover overlying said opening, a locking belt comprising:

an elongate band of a first synthetic resin, in use, for surrounding said annular end portion of the container and including means for retaining said cover on said annular end portion with opposite ends of the band spaced apart a locking structure of a second synthetic resin of higher strength than said first synthetic resin; and said locking structure mounted to the end portions of the band, so that, in use, said locking structure constricts the spaced ends of the band to secure the cover to the container.

14. The locking belt of claim 13 wherein said locking structure is of nylon.

15. The locking belt of claim 13 wherein said locking structure is of glass filed nylon.

16. The locking belt of claim 13 wherein said band comprises a C-shaped band in cross section having parallel upper and lower wall portions connected by a sidewall portion, in use, the sidewall portion extending around the container annular end portion with the lower wall portion extending into an annular recess in the annular end portion and the upper wall portion extending above an outer peripheral portion of the top wall.

* * * * *